US007582000B2

(12) United States Patent
Pendlebury et al.

(10) Patent No.: US 7,582,000 B2
(45) Date of Patent: Sep. 1, 2009

(54) METHOD OF MAKING AN ELECTROLUMINESCENT LIGHT

(75) Inventors: Steven Paul Pendlebury, Richmond, VA (US); Robert Joseph Ponticelli, Sr., Thousand Oaks, CA (US)

(73) Assignee: Electro-Luminx Lighting Corporation, Chester, VA (US)

( * ) Notice: Subject to any disclaimer, the term of this patent is extended or adjusted under 35 U.S.C. 154(b) by 664 days.

(21) Appl. No.: 11/326,737

(22) Filed: Jan. 7, 2006

(65) Prior Publication Data

US 2007/0161314 A1 Jul. 12, 2007

(51) Int. Cl.
*H01J 1/62* (2006.01)
*H01J 63/04* (2006.01)
*H01J 9/00* (2006.01)

(52) U.S. Cl. ..... 445/24; 445/25; 445/35; 313/483; 313/498; 313/500; 313/502; 313/504; 313/505; 313/506; 313/509; 313/511; 428/690; 428/917

(58) Field of Classification Search ..... None
See application file for complete search history.

(56) References Cited

U.S. PATENT DOCUMENTS

| | | | | |
|---|---|---|---|---|
| 5,005,306 A | | 4/1991 | Kinstler | 40/591 |
| 5,276,382 A | * | 1/1994 | Stocker et al. | 313/506 |
| 5,332,946 A | | 7/1994 | Eckersley et al. | 313/506 |
| 5,432,015 A | * | 7/1995 | Wu et al. | 428/690 |
| 5,444,930 A | | 8/1995 | Loew | 40/544 |
| 5,491,377 A | | 2/1996 | Janusauskas | 313/506 |
| 5,497,571 A | | 3/1996 | Tryon et al. | 40/544 |
| 5,518,561 A | | 5/1996 | Rosa | 156/71 |
| 5,533,289 A | | 7/1996 | Hoffman | 40/544 |
| 5,671,029 A | | 9/1997 | Haruki | 349/96 |
| 5,692,327 A | | 12/1997 | Wynne et al. | 40/205 |
| 5,814,417 A | * | 9/1998 | Nagayama | 428/690 |

(Continued)

*Primary Examiner*—Nimeshkumar D. Patel
*Assistant Examiner*—Natalie K Walford
(74) *Attorney, Agent, or Firm*—Roger H. Criss

(57) ABSTRACT

A method of making an electroluminescent (EL) light which includes at least one design. A flexible EL lamp is used which has a front electrode, a phosphor layer, a dielectric layer and a rear electrode layer. A pattern is cut out from the flexible EL lamp and at least one line is determined on the cut out to divide the design into at least two geometric areas, which are preferably of approximately equal size. A scribe line is cut into the rear electrode along such line, which forms split electrode areas in the rear electrode. Connecting devices are attached to each split electrode area, which are adapted to be connected to a power source.

A method of making an EL light that is adaptable to be inserted into a channel, with the light having at least one indicia such as a letter, number, symbol or the like. A first form of the desired indicia is cut out from a plastic backing sheet. A second form of the desired indicia is cut out from flexible EL lamp of the form mentioned above. A scribe line is cut into the rear electrode of the EL lamp along one or more predetermined lines. The EL lamp is laminated between at least two barrier films, and a connecting device is attached to each split electrode area of the rear electrode. Optionally, a third form of the desired indicia is cut from an outer overlay sheet. The three cut out forms are stacked on top of each other, with the EL lamp structure in the middle, and the periphery of the structure is sealed.

40 Claims, 7 Drawing Sheets

U.S. PATENT DOCUMENTS

| | | | | |
|---|---|---|---|---|
| 5,829,063 | A | 11/1998 | Cheng | 2/209.13 |
| 5,976,613 | A | 11/1999 | Janusauskas | 427/66 |
| 6,056,425 | A | 5/2000 | Appelberg | 362/493 |
| 6,143,434 | A * | 11/2000 | Okada | 428/690 |
| 6,187,611 | B1 | 2/2001 | Preston et al. | 438/106 |
| 6,203,391 | B1 | 3/2001 | Murasko | 445/24 |
| 6,416,885 | B1 * | 7/2002 | Towns et al. | 428/690 |
| 6,424,088 | B1 | 7/2002 | Murasko | 313/506 |
| 6,914,023 | B2 * | 7/2005 | Shimosaka et al. | 501/32 |
| 2001/0042329 | A1 | 11/2001 | Murasko et al. | 40/544 |
| 2002/0011786 | A1 | 1/2002 | Murasko et al. | 313/518 |
| 2003/0150146 | A1 | 8/2003 | Martin et al. | 40/544 |
| 2004/0080929 | A1 | 4/2004 | Golle et al. | 362/84 |
| 2004/0080959 | A1 | 4/2004 | Golle et al. | 362/540 |
| 2004/0108970 | A1 | 6/2004 | Nealon | 345/1.2 |
| 2005/0124258 | A1 | 6/2005 | Appelberg et al. | 445/24 |

* cited by examiner

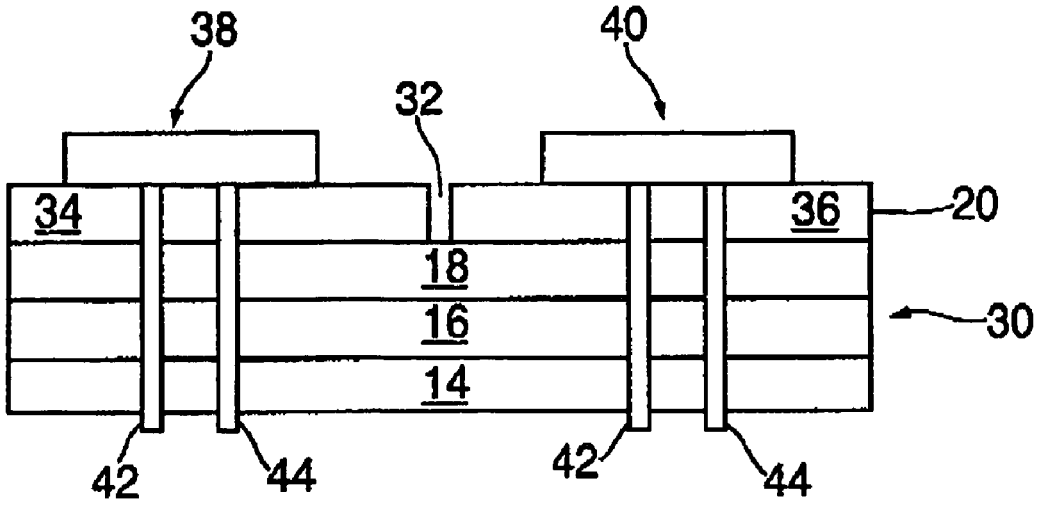
FIG. 4
FIG. 5A
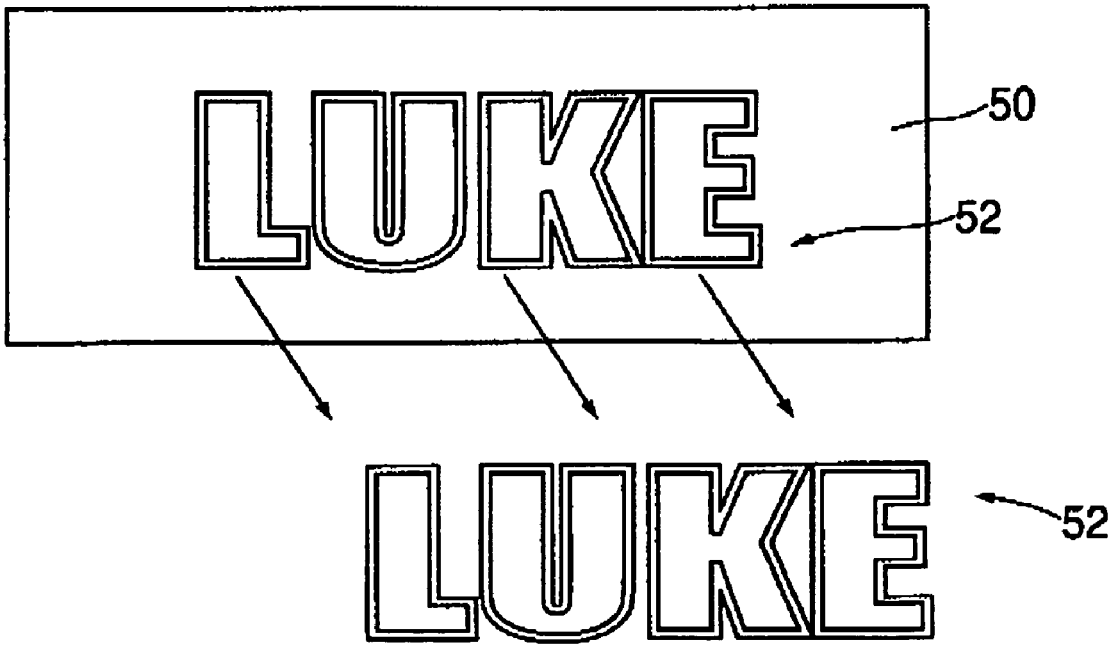
FIG. 5B

FIG. 6A
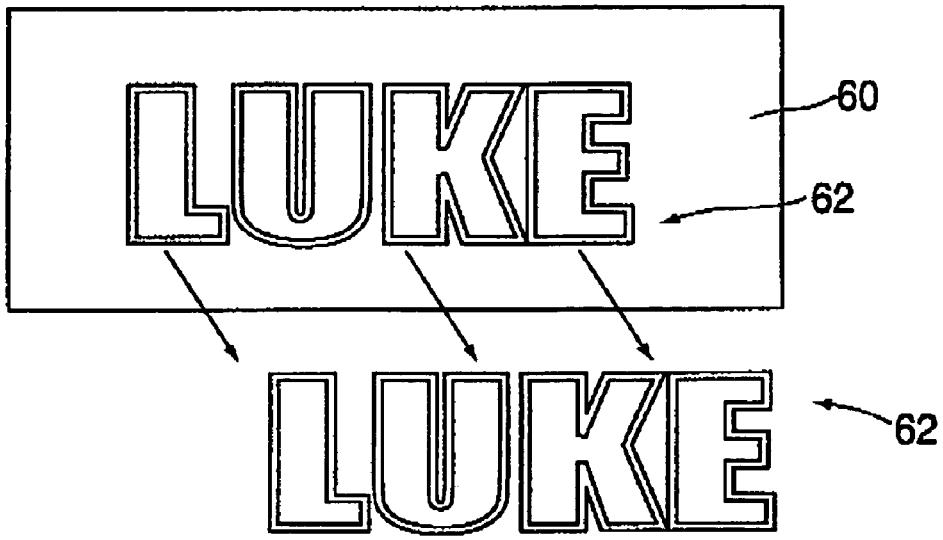
FIG. 6B
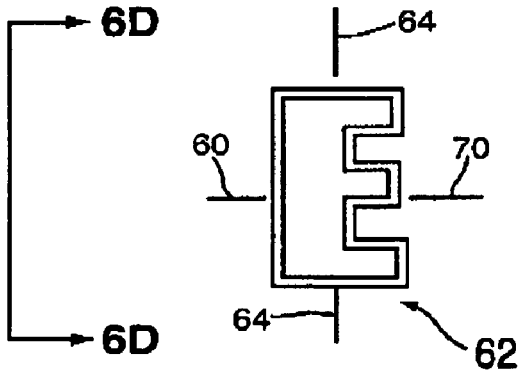
FIG. 6C
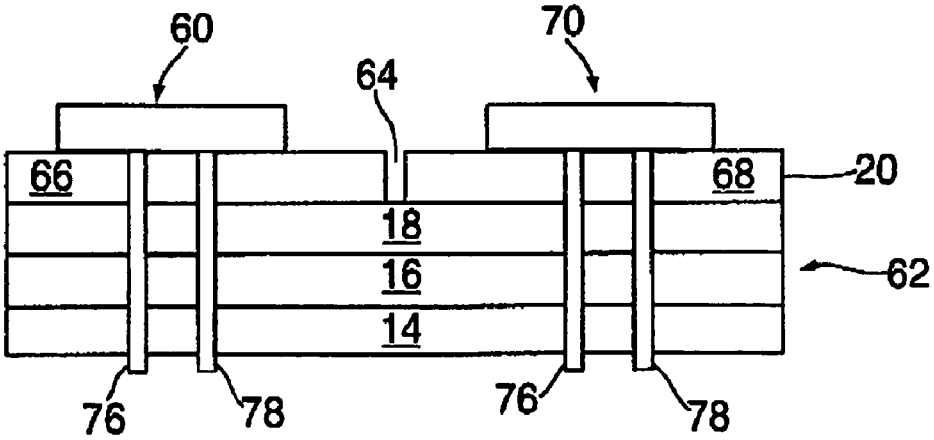
FIG. 6D

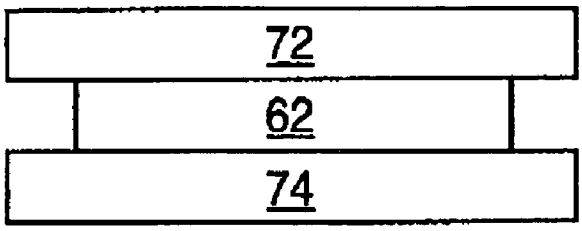
FIG. 7
FIG. 8A
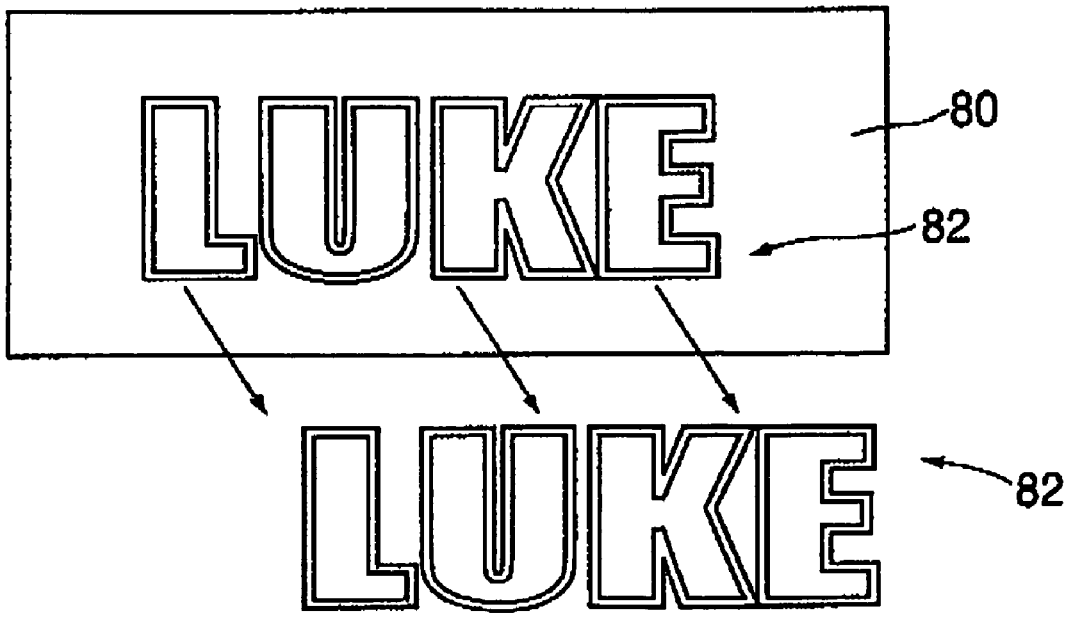
FIG. 8B

METHOD OF MAKING AN ELECTROLUMINESCENT LIGHT

BACKGROUND OF THE INVENTION

1. Field of the Invention

This invention relates to a method of making an electroluminescent light, and methods of using such lights.

2. Description of the Related Art

Lighted signs are of course well known. Typically, these signs use incandescent light bulbs, fluorescent light bulbs or neon light bulbs. One problem with such lighted signs is that they typically require a fairly thick overall structure when considering the thickness of their outer panel, inner lamp mechanism and mounting box. For applications such as channel lights where a light is positioned within a channel that can be mounted to a surface, the overall thickness makes them aesthetically unappealing. Such channel lights, which are typically used to display words, numbers and or symbols, are also subject to inadvertent physical contact as they protrude quite a distance from the building or other structure to which they are mounted.

In addition, such lighted signs are formed from glass that is susceptible to breakage, and/or gases which my be environmentally unfriendly. These signs have limited if any flexibility and generate heat when operated.

Furthermore, to create lighted signs with complicated shapes, such as a design of an animal or the like, requires intricate manufacturing and installation procedures with existing incandescent, fluorescent or neon type lighting structures.

It would be desirable to provide a method of making lighted signs and the like that do not suffer from the above disadvantages.

SUMMARY OF THE INVENTION

In accordance with this invention, there is provided a method of making an electroluminescent light comprising at least one design, the method comprising:

a) providing a flexible electroluminescent lamp, the lamp comprising a front electrode layer, a phosphor layer, a dielectric layer and a rear electrode layer;
b) cutting out a pattern forming the design from the flexible electroluminescent lamp;
c) determining on the rear electrode at least one line which divides the design into at least two desired geometric areas based on the desired performance of the light;
d) scribing the rear electrode layer along such line through the thickness of the rear electrode, but not substantially into the dielectric layer, to thereby form split electrode areas in the rear electrode layer; and
e) attaching a connecting device to each split electrode area of the rear electrode.

Also in accordance with this invention, there is provided a method of making an electroluminescent light that is adaptable to be inserted into a channel, the light comprising a least one indicia in the form of a letter, number, symbol, and/or design, the method comprising:

a) providing a plastic backing sheet;
b) cutting out a first form in the shape of the desired indicia from the backing sheet;
c) providing a flexible electroluminescent lamp, the lamp comprising a front electrode layer, a phosphor layer, a dielectric layer and a rear electrode layer;
d) cutting out a second form in the shape of the desired indicia from the flexible electroluminescent lamp;

e) determining on the rear electrode of the electroluminescent lamp at least one line which divides the second form into at least desired two geometric areas based on the desired performance of the light;
f) scribing the rear electrode layer of the second form along the line through the thickness of the rear electrode, but not substantially into the dielectric layer, to thereby form split electrode areas in the rear electrode layer;
g) sealing the scribed second form between at least two barrier films, the barrier films protecting the electroluminescent lamp against water and ultraviolet light penetration;
h) attaching a connecting device to each split electrode area of the rear electrode, the connecting devices being adapted to be connected to a power source;
i) optionally providing an outer overlay sheet formed from a colored, transparent, or translucent material;
j) optionally cutting out a third form in the shape of the desired indicia from the overlay sheet;
k) stacking the first and second forms, and optionally the third form with the second form between the first and third forms, to form a multilayer light structure; and
l) sealing the periphery of the multilayer sign structure with a sealing material to form a protective seal around its periphery.

In further accordance with this invention, there is provided a method of forming a large surface area electroluminescent lamp, the method comprising:

a) providing a relatively large flexible electroluminescent lamp panel, the lamp panel comprising a front electrode layer, a phospor layer, a dielectric layer and a rear electrode layer;
b) determining on the rear electrode layer of the lamp panel a plurality of lines that divide the panel into a plurality of smaller panel areas;
c) scribing the rear electrode layer along said plurality of lines through the thickness of the rear electrode but not substantially into the dielectric layer to thereby form a plurality of smaller split electrode areas in the rear electrode layer; and
d) attaching a connecting device to each split electrode layer of the rear electrode; whereby a large surface area electroluminescent lamp is provided that can be illuminated as one large area.

This invention also provides a method of splicing electroluminescent lamp structures to provide a seamless structure, the method comprising:

a) providing first and second flexible electroluminescent lamp structures, each of the lamp structures comprising a front electrode layer, a phospor layer, a dielectric layer and a rear electrode layer; each of the lamp structures having a terminal end; and each of the lamp structures having at least one scribe line which penetrates through the thickness of the rear electrode of each of the lamp structures so as to form split electrode areas in the rear electrode layer of each of said lamp structures;
b) abutting the terminal end of the first lamp structure with the terminal end of the second lamp structure, with the scribe line in the first lamp structure being aligned with the scribe line in the second lamp structure;
c) attaching a first conductive tape to the rear electrode layer of the first lamp structure and to the rear electrode layer of the second lamp structure, such that the first conductive tape is superimposed over the terminal ends of the first and second lamp structures to thereby attach the first and second lamp structures together, the first conductive tape being located on a first side of the aligned scribe lines of the first and second lamp structures; and d) attaching a second conductive tape to the rear electrode layer of the first lamp structure and to said rear electrode layer of the second lamp structure, such that the second conductive tape is superimposed over the terminal ends of the first and second lamp structures to thereby attach the first and second lamp structures together, the second conductive tape being located on a second side of the aligned scribe lines of the first and second lamp structures, which second side is on the opposite side of the aligned scribe lines from the first conductive tape;

whereby the first and second lamp structures are mechanically and electrically connected to each other.

The invention thus provides improved methods of making lighted structures, such as signs and the like, by utilizing electroluminescent lamp devices. These materials are flexible and can be formed into a desired shape. The thinness of the electroluminescent lamps makes them particularly useful in channel lighting applications. Such lights are relatively easy to manufacture, do not generate heat, do not contain breakable or possibly hazardous materials, use small amounts of power, are thin when installed and have other desirable features as described hereinafter.

BRIEF DESCRIPTION OF THE DRAWINGS

A more complete understanding of the invention can be obtained by considering the following detailed description in conjunction with the accompanying drawings, in which:

FIG. 4 is a cross-sectional view (not to scale) of the design of FIG. 3B along line 4-4.

FIG. 5A is a plan view of an indicia (name) formed on a backing layer.

FIG. 5B is a plan view of the form of the indicia cut out of the backing layer of FIG. 5A.

FIG. 6A is a plan view of the same indicia formed on an electroluminescent lamp.

FIG. 6B is a plan view of the form of the indicia cut out of the electroluminescent lamp of FIG. 6A.

FIG. 6C is a plan view of one part of the form of the indicia of FIG. 6B with a scribe line indicated and electrical connection leads attached.

FIG. 6D is cross-sectional view (not to scale) taken along line 6D of FIG. 6C.

FIG. 7 is a cross-sectional view (not to scale) of a lamination of the indicia of FIG. 6C sandwiched between two barrier films.

FIG. 8A is a plan view of the same indicia formed on an overlay layer.

FIG. 8B is a plan view of the form of the indicia cut out of the overlay layer of FIG. 8A.

DETAILED DESCRIPTION OF THE INVENTION

The electroluminescent lights manufactured in accordance with this invention incorporate electroluminescent (or EL) lamps. These EL lamps are flexible and generally include a transparent front electrode layer, a phosphor layer, a dielectric layer and a rear electrode. Preferably, the EL lamps used in the present invention and their manufacture are those described in U.S. Pat. No. 5,491,377 to Janusauskas and U.S. Pat. No. 5,976,613 to Janusauskas, the disclosures of which are expressly incorporated herein by reference.

Figure 1:
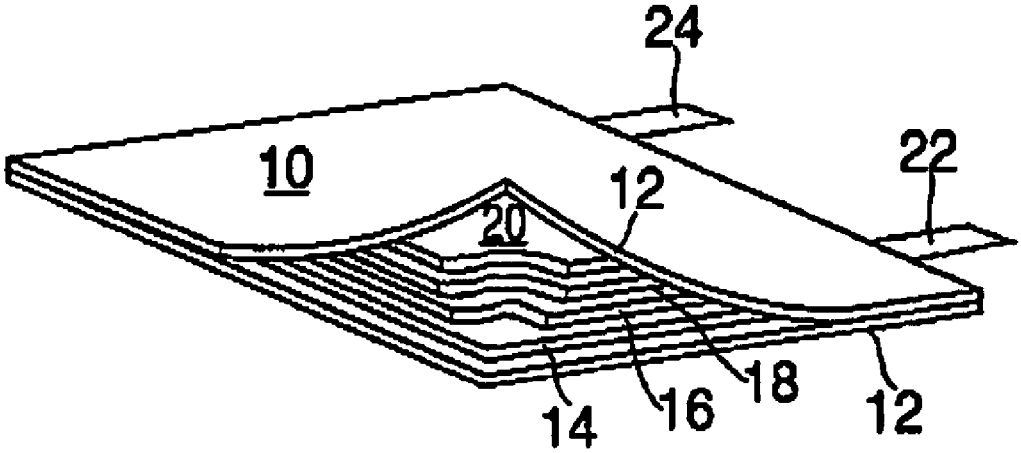
FIG. 1 is a pictorial view of an electroluminescent lamp employed in the present invention.

In one embodiment of an EL lamp that is shown in FIG. 1, the lamp may be in the form of a flexible panel 10 which may comprise a multilayer inner cell sealed within an outer moisture resistant envelope 12.

Within the active cell are shown four layers, i.e., a front electrode layer 14, a phosphor layer 16, a dielectric layer 18 and a rear electrode layer 20. The electrodes 14 and 20 may be provided with external silver or other leads 22 and 24 respectively during the manufacturing process, or alternatively with ribbon connectors each being adapted for connection to a suitable source of power (preferably AC, although DC with an inverter is also applicable). As is known in the art, the application of an electrical potential across the two electrode layers 14 and 20 results in the excitation of the phosphor layer 16.

Figure 2:
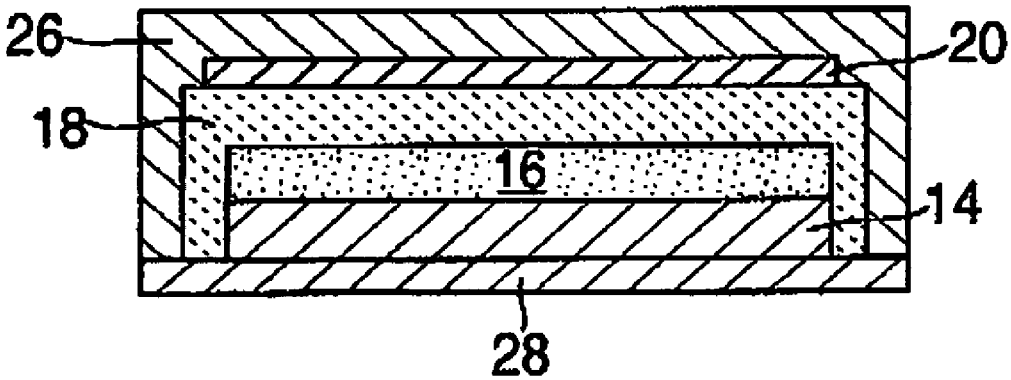
FIG. 2 is a cross-sectional view (not to scale) of the electroluminescent lamp of FIG. 1.

As shown more clearly in the elevational view of a cross-section of FIG. 1 illustrated in FIG. 2, the phosphor layer 16 is immediately contiguous to the front electrode layer 14 but spaced from and electrically isolated from the rear electrode layer 20 by a dielectric layer 18. This phosphor sandwich is protected from the rear by an overcoat 26.

Additional exterior layers or interior layers may also be employed in the invention. Preferably, the various layers are formed by extrusion through a slot die, or they may alternatively be formed by a screen printing manufacturing process. Front conductor layer 14 may be formed on any suitable material, such as a polyester layer 28. The polyester layer may be heat stabilized. The front conductor layer comprises conventional indium tin oxide (ITO) compounds in a binder. Preferably, the binder is a fluoropolymer, such as polyvinylidene fluoride. A typical composition from which the front conductor layer 14 is formed comprises, in weight percents based on the total weight of the composition, of from about 50 to about 85 percent indium tin oxide compounds, from about 5 to about 25 percent of 2-(2-ethoxyethoxy)-ethyl acetate, from about 5 to about 25 percent of 2-butoxyethyl acetate, and from about 2 to about 30 percent of polyvinylidene fluoride. Typical thicknesses of the front electrode layer 14 range from about 15 to about 40 microns, more preferably from about 20 to about 25 microns.

The phosphor layer 16 may include any suitable conventional phosphor such as copper activated zinc sulfide in a suitable binder, preferably a fluoropolymer binder such as polyvinylidene fluoride. In one preferred embodiment, the binder is substantially the same as employed for the front electrode layer 14. For example, the phosphor layer 16 may comprise, in weight percents based on the total weight of the composition, from about 50 to about 60 percent of copper activated zinc sulfide, about 5 to about 25 percent of 2-(2-ethoxyethoxy)-ethyl acetate, about 5 to about 25 percent of 2-butoxyethyl acetate, and about 2 to about 30 percent of polyvinylidene fluoride. Typically, the thickness of the phosphor layer 16 ranges from about 30 to about 60 microns, more preferably from 45 to about 50 microns.

The dielectric layer 18 may include any suitable conventional dielectric powder, such as white dielectric powder, in a suitable binder. Preferably, the binder comprises a fluoropolymer binder such as polyvinylidene fluoride. More preferably, the binder is substantially the same as employed in the front electrode layer 14 and the dielectric layer 16. In one embodiment, the white dielectric powder may be an admixture of titanium dioxide (20-60 wt. %), silicon dioxide (3-10 wt. %), and aluminum silicate (3-10 wt. %). The dielectric layer is preferably formed from a composition which comprises, in weight percents based on the total weight of the composition, from about 50 to about 60 percent of the dielectric powder, about 5 to about 25 percent of 2-(2-ethoxyethoxy)-ethyl acetate, about 5 to about 25 percent of 2-butoxyethyl acetate, and about 2 to about 30 percent of polyvinylidene fluoride. Typically, the thickness of the phosphor layer 16 ranges from about 5 to about 20 microns, more preferably from about 10 to about 15 microns.

The rear electrode layer 20 may include suitable conventional conductive ink or silver, carbon, or ceramic, or blends of carbon silver or nickel silver, in a suitable binder. Again, preferably the binder is a fluoropolymer binder, such as polyvinylidene fluoride. Also, the binder may be substantially the same binder as employed in the other layers mentioned above. Preferably, the rear electrode is formed from a composition which comprises, in weight percents based on the total weight of the composition, from about 50 to 85 percent metallic silver, from about 5 to about 25 percent of 2-(2-ethoxyethoxy)-ethyl acetate, from about 5 to about 25 percent 2-butoxyethyl acetate and from about 2 to about 30 percent of polyvinylidene fluoride.

The protective overcoat 26 may comprise any suitable conventional material such as a fluoropolymer powder (e.g., Teflon® PFA powder). The overcoat composition preferably includes a fluoropolymer binder, such as polyvinylidene fluoride, and may be substantially the same as the binders of the other layers. In a preferred embodiment, the protective overcoat 26 is formed from a composition comprising, with about 5 to about 25 percent fluoropolymer powder (e.g., Teflon® #532-5011), and a binder comprising in weight percent of the binder, from about 15 to about 45 percent of 2-(2-ethoxyethoxy)-ethyl acetate, from about 10 to about 45 percent 2-butoxyethyl acetate, and from about 20 to about 80 percent polyvinylidene fluoride. Typically, the thickness of the overcoat layer is from about 5 to about 30 microns, more preferably from about 15 to about 20 microns.

In each of the aforesaid layers, conventional additives may be added in conventional amounts, such as, for example, 2 to 10 weight percent based on the total weight of the respective composition.

By use of a fluoropolymer binder such as polyvinylidene fluoride for all of the layers of the lamp, a thick film lamp may be produced which has high resistance to many chemical solvents, to ultraviolet and nuclear radiation, weathering, fungi and a low water transmission rate The use of a common binder results in a lamp in which the various layers have a similar coefficient of temperature expansion, thus significantly reducing failures from exposure to elevated temperatures, and the inclusion of an ultraviolet absorbing component in the binder for at least the phosphor, and preferably all layers, obviates the need for and expense of an additional UV resistant coating.

The use of a common binder for both phosphor and adjacent dielectric layers also reduces lamp failure due to localized heating, thus increasing light output for a given voltage and excitation frequency, and increasing the ability of the lamp to withstand overvoltage conditions without failure.

EL lamps of the above structure are available from ElectroLuminiX of the USA under the trademark Light Tape®.

Figure 3A:
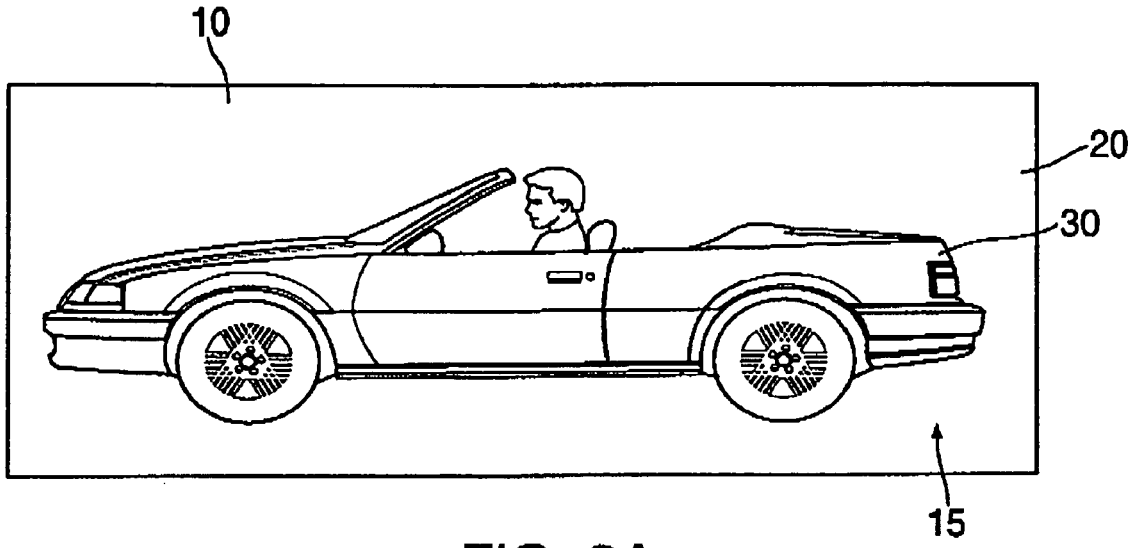
FIG. 3A is a view of a design on the electroluminescent lamp of FIG. 1.
Figure 3B:
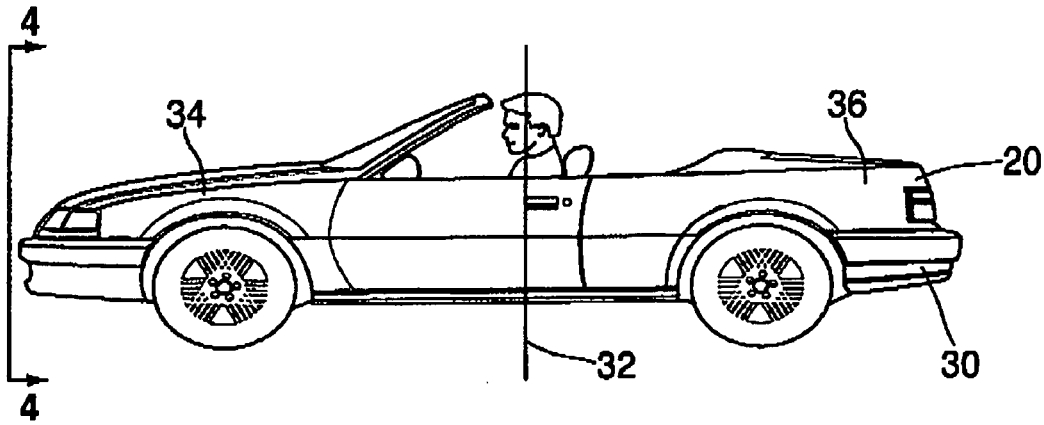
FIG. 3B is view of the design after it has been cut out from the lamp of FIG. 3A.

The EL lamp structure is formed as a continuous flexible sheet which may be rolled up. In accordance with the method of this invention, a desired pattern is cut out from a section of the EL lamp sheet material, which section may be any desired size. The pattern may be printed on the EL lamp by any conventional means, for example a digital printer can print the desired shape or pattern as a template or overlay to aid in cutting in the field. Alternatively, the desired image can be loaded into a computer which is integrated with the cutter to cut the desired pattern. As shown in FIGS. 3A and 3B, the chosen design may be any desired design. FIG. 3A depicts a sheet 15 of EL lamp 10 having a pattern 30 formed thereon. Pattern 30 is preferably cut out from sheet 15 using a non-metal laser cutting machine in order to provide an accurate pattern. More expensive metal laser cutting machines are not required, but of course may be used. Likewise, any suitable cutting device can be employed. The pattern shown in FIG. 3B depicts the design with the rear electrode layer 20 facing outwardly.

The shape of the pattern may be symmetrical or asymmetrical and may be of any desired or custom shape. The pattern may readily be cut from the EL lamp in the field with basic tools.

A scribe line 32 is determined on the rear electrode 20 of EL lamp 10. Such line can be determined manually or through the use of a laser. A scribe is then made along line 32 through the entire thickness of rear electrode layer 20, but not substantially into dielectric layer 18. The location of the scribe line depends on the desired performance of the light. For example, if it is desired that the light be seen without flashing and as a continuous light source, then scribe line 32 is made along a line which divides the pattern into two approximately geometrically equal areas 34 and 36. If the areas 34 and 36 are not approximately equal, then the EL lamp structure will flash imbalanced illumination as one hemisphere receives more current that the other(s). By having uneven areas of the split electrode results in the ability to make varying brightness lamps. For some applications such flashing may be desirable, but for a constant on light such flashing would not normally be desirable. The line 32 may be scribed with any suitable implement, such as a scribe tool with a metal cutting bit. Although scribe line 32 is shown as a vertical line, it may alternatively be a horizontal line, a diagonal line, a curve, etc.

It should be noted that more than one scribe line 32 may be cut into the rear electrode layer 20 of pattern 30, and that the resultant cut areas may or not be of equal area, again depending upon the desired performance characteristics of the light. Multiple scribe lines will allow the conductive layers to carry current more efficiently, thus enabling large format lights. Regardless of the number of scribe lines made, rear electrode layer 20 is split into at least two areas which form split electrode areas shown by numerals 34 and 36.

FIG. 4 depicts in a cross-sectional view the pattern 30 cut from EL lamp 10, with the rear electrode layer 20 facing upwards. To utilize the EL lamp as the desired light structure, electrical connectors 38, 40 (shown schematically) each having penetrating teeth 42, 44 are connected to the split electrode areas 34, 36 and are connected to an AC power supply (or DC power with inverter) in a conventional manner by connecting the two leads (no polarity) to the two output connections coming from the power supply (not shown).

In use, the light formed from pattern 30 of material 15 is preferably attached to other layers, including an overlay sheet and a backing sheet (not shown). Thus a backlit structure is created which can be used indoors or outdoors and may be of any suitable design. The indicia may be in the form of individual letters, numbers, symbols and/or designs, as well as a plurality of such indicia which are interconnected with one another.

Thus it can be seen that EL lights of custom shapes (both regular and irregular) can be easily made using the EL lamps and method of this invention.

In another aspect of this invention, there is provided a method of making an EL light that is adapted to be inserted into a channel. The method includes the cutting out of a desired indicia from at least two layers—a plastic backing sheet and an EL lamp layer. Turning now to FIGS. 5A and 5B, an indicia, in this case several letters forming a name, indicated by reference numeral 52, is cut from a backing sheet layer 50. The indicia may be any suitable one or more letters, numbers, symbols and/or designs, and more than one type of them may be used. For example, indicia 52 may be in the form of multiple letters which are interconnected with one another, such as in the form of script letters, or may otherwise be connected. Alternatively, the individual letters may be separately connected to the power source with leads connected to each letter. FIG. 5B depicts indicia 52 after being cut out from backing sheet 50.

Backing sheet layer 50 may be formed from any suitable material that provides the desired structural support to the light. Backing sheet layer 50 preferably is formed from a sheet of suitable plastic material, such as acrylics, polycarbonates, polyvinyl chloride (PVC), fiberglass and other non-conductive materials. The thickness of backing sheet layer 50 may range, for example, from about 0.1 to about 3 inches (0.25 to 7.6 cm).

Any suitable device or equipment may be used to provide the cutting out of indicia 52, although a non-metal laser cutting machine is preferred. The backing sheet indicia 52 is preferably cut somewhat larger than the EL lamp indicia mentioned below, so as to provide edges that extend outwards to accommodate a barrier lamination edge seal. The layers of the light may be cut in one or more steps.

In a similar manner, with reference to FIGS. 6A and 6B a sheet 60 of EL lamp layer 10 is cut to form the desired indicia 62, preferably in the same shape as indicia 52. The same or different type of cutting apparatus employed for the backing sheet layer 50 may be used for this purpose. FIG. 6B illustrates indicia 62 after it has been cut from sheet 60.

With reference to FIG. 6C, at least one scribe line 64 is formed in indicia 62. For ease of view, only one letter of indicia 62 is shown in FIG. 6C. Although shown as a vertical line, the scribe line may alternatively extend horizontally, diagonally or at any other angle, or may be a curve, etc. As shown in cross-sectional view FIG. 6D, scribe line 64 extends through rear electrode layer 20 but not substantially into dielectric layer 18. Scribe line 64 splits the rear electrode layer 20 into at least two geometric areas 66 and 68. As described above with respect to FIG. 3, the location of the scribe line is chosen based on the desired performance of the light. If a constant lit structure is desired, then areas 66 and 68 are of approximate equal area, but if flashing of the light is desired, then areas 66 and 68 may be unequal.

Electrical connection tabs 60, 70 shown schematically in FIG. 6C are attached by suitable means to each of the split electrode areas 66 and 68. Their connection is similar to that described with respect to FIG. 4. In general, there are two metal tabs 76, 78 (FIG. 6D) for each connection, with one for each side of the electrode. The tabs are conductive with penetrating teeth or spikes protruding generally perpendicular to the main surface of the tabs. The teeth or spikes are forced through the rear electrode forming a connection to carry the current into the lamp. Alternatively, conductive tapes or tabs may be attached by an adhesive to the surface of the rear electrode. The connectors are then connected to the conductive tape which is applied to the lamp for final connection. Conductive tapes or tabs with adhesive are particularly useful for connections in which it is desired not to alter or intrude into the face of the lamp and thus block light. Tabs 60, 70 are adapted to be connected to a power source, such as an AC power source or DC with inverter.

As shown in FIG. 7, to provide additional barrier protection to the EL lamp structure in the form of indicia 62, the lamp is laminated between two clear barrier film sheets 72, 74. Such barrier film provides additional protection against water vapor, ultraviolet light and other deleterious materials. Preferably, barrier film sheets 72, 74 are formed from fluoropolymer materials such as chlorotrifluoroethylene polymers; a preferred material is Clarus® polychlorotrifluoroethylene films available from Honeywell International Inc., Morristown, N.J. USA. Such films may have a thickness of between about 0.2 to about 10 mils (5.1 to 254 μm), more preferably from about 0.5 to about 6 mils (12.7 to about 152.4 μm).

The barrier film sheets 72, 74 are laminated with the EL lamp structure 62, with the EL lamp between the barrier film sheets. Any suitable lamination technique may be employed, such as thermal lamination, cold lamination or pressure lamination. Excess barrier film is trimmed around the periphery of indicia 62 so that a lamination seal of about 0.25 inch (0.64 cm) is formed around the edges of EL lamp indicia 62.

Preferably, an overlay layer is employed in the light structure. With reference to FIGS. 8A and 8B, the desired indicia 82 is cut out from overlay layer 80, using the same or different equipment employed with the other layers and in the same or separate step. FIG. 8B depicts indicia 82 after being cut from layer 80. Overlay layer 80 may be in the form of a colored, transparent or translucent layer, such as a plastic layer. Materials useful as overlay 80 include thin PVC, acrylic, polyester or other plastic sheets that may be uniform in color or contain a digital image such as a logo. Overlay layer 80 provides additional weathering and/or impact protection for indicia layer 62 that forms the EL lamp. It may also provide a desired color or other appearance to the light. Preferably, the overlay layer indicia 82 is cut as to be slightly wider than the EL lamp indicia 62. For example, overlay layer indicia 82 may be cut so as to extend a distance of about 0.1 inch (0.25 cm) over the edges of EL lamp indicia 62.

Figure 9:
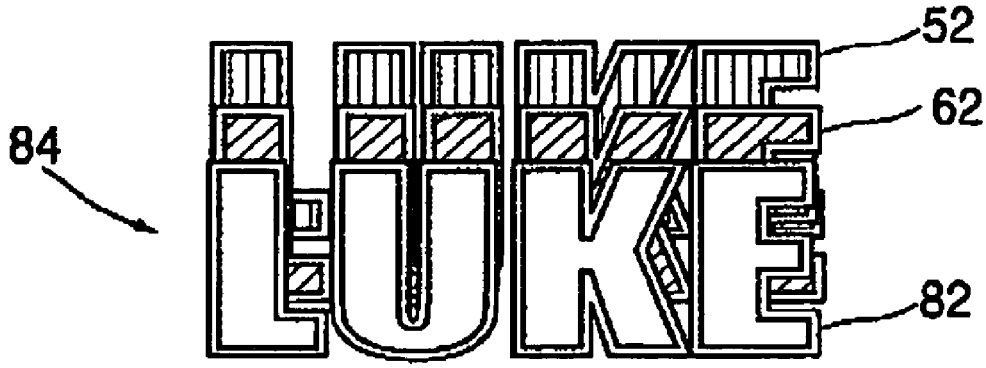
FIG. 9 is a view depicting the overlaying of three forms of indicia.

As shown in FIG. 9, indicia 52 and 62 (as well as 82 if utilized) are overlayed one on top of the other, with EL lamp indicia 62 positioned between backing sheet layer indicia 52 and overlay layer indicia 82. This forms a multilayer light structure designated as numeral 84. As mentioned above, preferably the edges of indicia 52 and 82 extend outwardly from the edges of indicia 62. To prevent moisture from penetrating through the edges of the light structure, the edges are preferably sealed with an adhesive bead of a suitable material. Alternatively, the edges of the lamp may be sealed with a barrier film (e.g., a PCTFE film) that has adhesive coated on one side. The barrier film is folded in length in half and applied to the edge of the lamp to provide an effective seal.

In use, connection tabs 60, 70 of indicia 62 are adapted to be connected to a power source, such as an AC power source, by conventional wiring. Of course, if multiple indicia such as words formed from multiple letters are desired, then the letters are interconnected so that there is electrical continuity with all of the indicia. Alternatively, each letter may be connected to the power source by means of a plurality of connectors. The multilayer light structure 84 may be very thin, such as on the order of from about 0.5 to about 4 inches (1.3 to 10.2 cm), more preferably from about 1 to about 3 inches (2.5 to 7.6 cm) or so. The multilayer light structure 84 is insertable into a channel mounting structure (not shown) or without backing to form an EL light structure on a desired mounting surface.

As can be seen from the above description, the method described herein allows the construction of custom signs of various shapes in the field. The flexible EL lamp stock material can be purchased by a sign shop, and using relatively inexpensive equipment a desired custom sign of a desired shape can be readily manufactured. The use of split electrode technology in the EL light structure permits intricate shapes to be cut and connected economically versus bus bar technology. The laminate structures are designed so that a manufacturer can cut and supply a replacement light structure when the originally installed lamp burns out.

The individual shapes, images and channel letters can be mounted on a variety of surfaces, such as billboards, industrial and corporate buildings, moving vehicles, machines, and entertainment, office and retail spaces.

Figure 10:
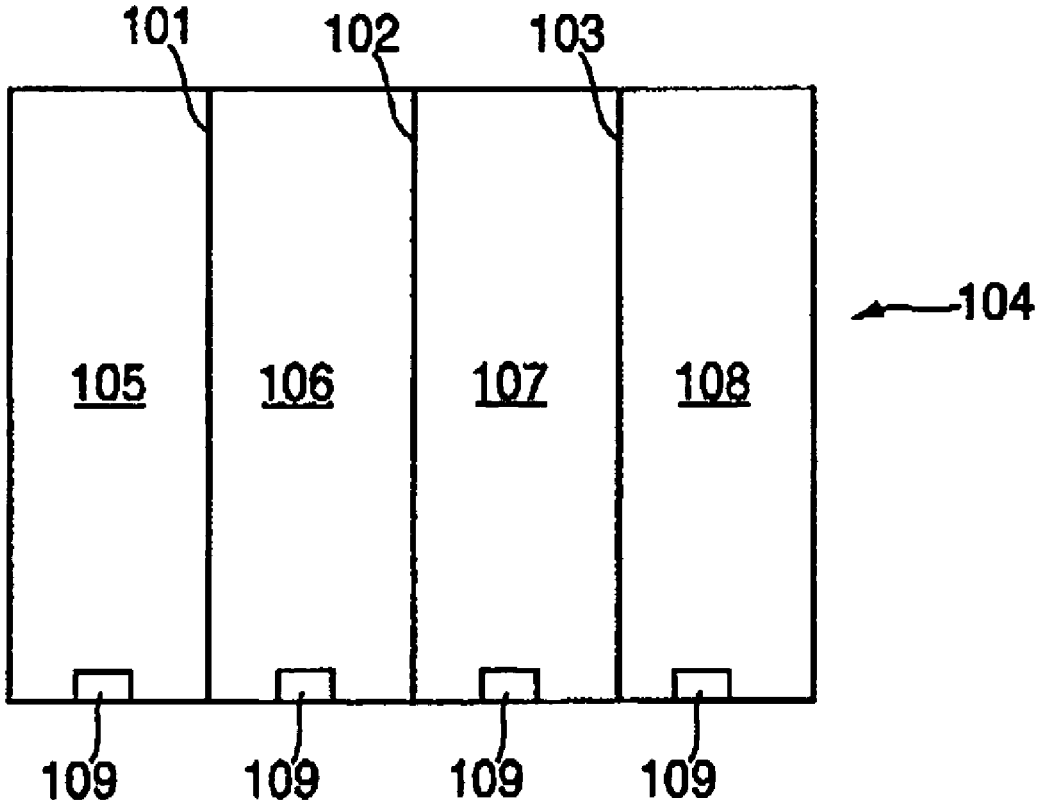
FIG. 10 is a plan view of a large format light panel that has been divided into two panels.

The invention also facilitates the production of large format panels. For example, as shown in FIG. 10, multiple scribe lines 101, 102, 103 can be provided in large format lamp panel 104 to divide panel 104 into four smaller panels 105, 106, 107, 108. Preferably smaller panels 105, 106, 107 and 108 are of the same approximate area. By attaching connectors 109 to the four smaller panels, a lamp structure is provided which enables a large surface area to be illuminated as one piece.

Figure 11:
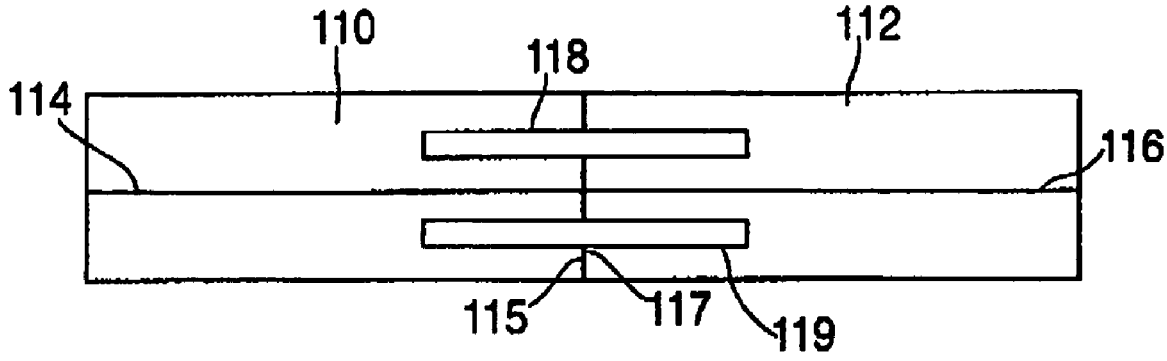
FIG. 11 is a plan view of a spliced lamp structure.

In addition, as shown in FIG. 11 seamless repairs can be achieved to join two lamp structures together by using conductive tapes between the two lamp structures as splices. As shown, lamp sections 110, 112, each having terminal ends 115, 117. Each lamp section has a scribe line 114, 116. The terminal ends 115, 117 are abutted together, with scribe lines 114, 116 aligned. The lamp sections can be connected via conductive tapes 118, 119 that are superimposed over terminal ends 115, 117 such that tapes 118, 119 are on opposite sides of scribe lines 114, 116. As a result, lamp sections 110, 112 are both mechanically and electrically attached. The conductive tapes pass current from one section of the lamp structure to the other section, thereby electrically joining the two lamp structures together.

Figure 12:
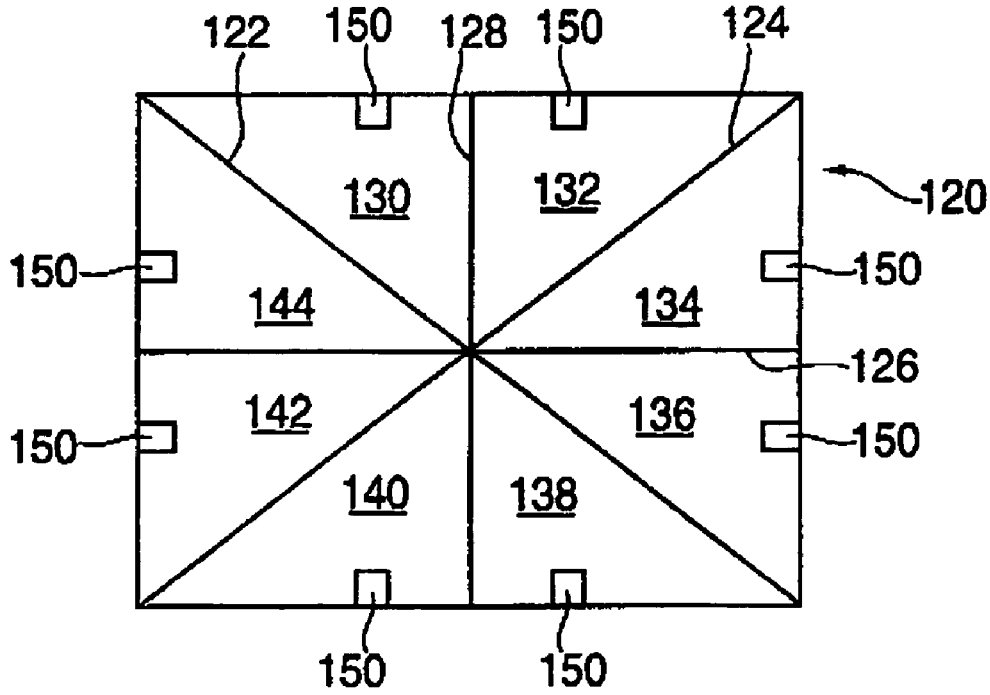
FIG. 12. is a plan view of a light panel that has been divided into a number of lamps.

A multiple of lamp structures can be formed by scribing one panel multiple times. For example, as shown in FIG. 12, panel 120 of an EL lamp are provided with four scribe lines, namely diagonal scribe lines 122 and 124, horizontal scribe line 126 and vertical scribe line 128. These lines are shown as intersecting at the center of panel 120. A total of eight lamps (130, 132, 134, 136, 138, 140, 142, 144) are thus formed. Each lamp structure is then connected via connectors 150 and can be flashed or sequenced as desired.

Other uses of the structure of this invention will become apparent to those skilled in the art.

The use of a split electrode EL lamp structure such as Light Tape® has many advantages over neon, incandescent, LED and fluorescent light fixtures. The EL light structure of the present invention is flexible and has a low profile, contains no mercury or gases, has extremely low operation cost, has low maintenance and is easily installed, is vibration and shock resistant, can be custom cut and spliced in the field, is lightweight, is cool to the touch (no heat), is visible through smoke and fog, can be powered by AC or low voltage batteries, provides a continuous uniform light, has no glass that is breakable, and can be custom cut into intricate shapes. Since the lamp structure has a thin profile, it reduces the hazards in areas of pedestrian traffic, even if the light structure is mounted in a position lower than usual.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A method of making an electroluminescent light comprising at least one design, said method comprising:

a) providing a flexible electroluminescent lamp, said lamp comprising a front electrode layer, a phosphor layer, a dielectric layer and a rear electrode layer;

b) cutting out a pattern forming said design from said flexible electroluminescent lamp;

c) determining on said rear electrode at least one line which divides said design into at least two desired geometric areas based on the desired performance of said light;

d) scribing said rear electrode layer along said line through the thickness of said rear electrode, but not substantially into said dielectric layer, to thereby form split electrode areas in said rear electrode layer; and e) attaching a connecting device to each split electrode area of said rear electrode.

2. The method of claim 1 wherein said line on said rear electrode is located such that it divides said design into two approximately geometrically equal areas.

3. The method of claim 1 wherein said design is in the form of a desired symmetrical or asymmetrical shape.

4. The method of claim 1 wherein said design is in the form of individual letters, numbers and/or symbols.

5. The method of claim 4 wherein said design is in the form of a plurality of letters, numbers and/or symbols that are interconnected with each other.

6. The method of claim 1 wherein step b) is carried out using a non-metal laser cutting machine.

7. The method of claim 1 wherein said rear electrode comprises silver.

8. The method of claim 1 wherein said front electrode layer of said lamp comprises an indium tin oxide layer in a first fluoropolymer binder, said phosphor layer of said lamp is bound in a second fluoropolymer binder, said dielectric layer of said lamp is bound in a third fluoropolymer binder, and said rear electrode of said lamp is bound in a fourth binder.

9. The method of claim 8 wherein said first, second and third fluoropolymer binders are substantially the same.

10. The method of claim 9 wherein said fourth binder of said rear electrode comprises a fluoropolymer binder.

11. The method of claim 8 wherein front electrode layer comprises said indium tin oxide layer on a polyester film.

12. The method of claim 11 wherein said indium tin oxide layer comprises from about 50 to about 85 weight percent of indium tin oxide based on the weight of said indium tin oxide layer.

13. The method of claim 12 wherein said first fluoropolymer binder comprises from about 2 to about 30 weight percent based on the weight of said indium tin oxide layer.

14. The method of claim 8 wherein said phosphor layer comprises individually coated phosphor particles.

15. The method of claim 14 wherein said second fluoropolymer binder comprises from about 2 to about 30 weight percent based on the weight of said phosphor layer.

16. The method of claim 8 wherein said rear electrode is formed from a conductive ink in said fourth binder.

17. The method of claim 1 wherein said front electrode comprises an indium tin oxide sputtered polyester film.

18. A method of making an electroluminescent light for insertion into a channel, said light comprising a least one indicia in the form of a letter, number, symbol, and/or design, said method comprising: a) providing a plastic backing sheet; b) cutting out a first form in the shape of the desired indicia from said backing sheet; c) providing a flexible electroluminescent lamp, said lamp comprising a front electrode layer, a phosphor layer, a dielectric layer and a rear electrode layer; d) cutting out a second form in the shape of said desired indicia from said flexible electroluminescent lamp; e) determining on said rear electrode of said electroluminescent lamp at least one line which divides said second form into at least desired two geometric areas based on the desired performance of said light; f) scribing said rear electrode layer of said second form along said line through the thickness of said rear electrode, but not substantially into said dielectric layer, to thereby form split electrode areas in said rear electrode layer; g) sealing said scribed second form between at least two barrier films, said baffler films protecting said electroluminescent lamp against water and ultraviolet light penetration; h) attaching a connecting device to each split electrode area of said rear electrode, said connecting devices being adapted to be connected to a power source; i) stacking said first and second forms to form a multilayer light structure; and j) sealing the periphery of said multilayer sign structure with a sealing material to form a protective seal around said periphery.

19. The method of claim 18 wherein said line on said rear electrode is located such that it divides said design into two approximately geometrically equal areas.

20. The method of claim 18 wherein step d) is carried out using a non-metal laser cutting machine.

21. The method of claim 18 wherein said rear electrode comprises silver.

22. The method of claim 18 wherein said front electrode layer of said lamp comprises an indium tin oxide layer in a first fluoropolymer binder, said phosphor layer of said lamp is bound in a second fluoropolymer binder, said dielectric layer of said lamp is bound in a third fluoropolymer binder, and said rear electrode of said lamp is bound in a fourth binder.

23. The method of claim 22 wherein said first, second and third fluoropolymer binders are substantially the same.

24. The method of claim 23 wherein said fourth binder of said rear electrode comprises a fluoropolymer binder.

25. The method of claim 22 wherein said front electrode layer comprises said indium tin oxide layer on a polyester film.

26. The method of claim 25 wherein said indium tin oxide layer comprises from about 50 to about 85 weight percent of indium tin oxide based on the weight of said indium tin oxide layer.

27. The method of claim 26 wherein said first fluoropolymer binder comprises from about 2 to about 30 weight percent based on the weight of said indium tin oxide layer.

28. The method of claim 22 wherein said phosphor layer comprises individually coated phosphor particles.

29. The method of claim 28 wherein said second fluoropolymer binder comprises from about 2 to about 30 weight percent based on the weight of said phosphor layer.

30. The method of claim 22 wherein said rear electrode is formed from a conductive ink in said fourth binder.

31. The method of claim 18 wherein said front electrode comprises an indium tin oxide sputtered polyester film.

32. The method of claim 18 wherein said step g) comprises scaling said scribed second shape between said at least two barrier films such that the scribed second shape is encapsulated by said barrier films and said barrier films have peripheral edge sealed portions that extend laterally from the edges of said scribed second shape.

33. The method of claim 32 wherein said barrier films comprise polychlorotrifluoroethylene.

34. The method of claim 18 wherein said desired indicia is in the form of a plurality of letters, numbers, symbols and/or designs that are interconnected with each other.

35. The method of claim 18, further comprising the step of:

m) connecting a power source to said multilayer sign structure via said connecting devices attached to said split electrode areas.

36. A light formed by the method of claim 1.

37. A light formed by the method of claim 18.

38. A method of forming a large surface area electroluminescent lamp, said method comprising:

a) providing a relatively large flexible electroluminescent lamp panel, said lamp panel comprising a front electrode layer, a phosphor layer, a dielectric layer and a rear electrode layer;

b) determining on said rear electrode layer of said lamp panel a plurality of lines that divide said panel into a plurality of smaller panel areas;

c) scribing said rear electrode layer along said plurality of lines through the thickness of said rear electrode but not substantially into said dielectric layer to thereby form a plurality of smaller split electrode areas in said rear electrode layer; and d) attaching a connecting device to each split electrode area of said rear electrode; whereby said large surface area electroluminescent lamp is provided that can be illuminated as one large area.

39. The method of claim 38 wherein said smaller panels each have approximately the same area.

40. A method of splicing electroluminescent lamp structures to provide a seamless structure, said method comprising:

a) providing first and second flexible electroluminescent lamp structures, each of said lamp structures comprising a front electrode layer, a phosphor layer, a dielectric layer and a rear electrode layer; each of said lamp structures having a terminal end; and each of said lamp structures having at least one scribe line which penetrates through the thickness of the rear electrode of each of said lamp structures so as to form split electrode areas in said rear electrode layer of each of said lamp structures;

b) abutting said terminal end of said first lamp structure with said terminal end of said second lamp structure, with said scribe line in said first lamp structure being aligned with said scribe line in said second lamp structure;

c) attaching a first conductive tape to said rear electrode layer of said first lamp structure and to said rear electrode layer of said second lamp structure, such that said first conductive tape is superimposed over said terminal ends of said first and second lamp structures to thereby attach said first and second lamp structures together, said first conductive tape being located on a first side of said aligned scribe lines of said first and second lamp structures; and d) attaching a second conductive tape to said rear electrode layer of said first lamp structure and to said rear electrode layer of said second lamp structure, such that said second conductive tape is superimposed over said terminal ends of said first and second lamp structures to thereby attach said first and second lamp structures together, said second conductive tape being located on a second side of said aligned scribe lines of said first and second lamp structures, which second side is on the opposite side of said aligned scribe lines from said first conductive tape;

whereby said first and second lamp structures are mechanically and electrically connected to each other.

* * * * *